United States Patent [19]

Johnston

[11] Patent Number: 4,491,471

[45] Date of Patent: Jan. 1, 1985

[54] COMPOSITE PELLET FOR USE AS A CARBOTHERMIC REDUCTION FEED

[75] Inventor: Thomas J. Johnston, Rogersville, Ala.

[73] Assignee: Reynolds Metals Company, Richmond, Va.

[21] Appl. No.: 570,822

[22] Filed: Jan. 16, 1984

[51] Int. Cl.[3] ..... C22B 1/24; C22B 21/02

[52] U.S. Cl. ..... 75/0.5 R; 75/3; 75/10 R; 75/68 A; 75/257

[58] Field of Search ..... 75/68 R, 68 A, 68 B, 75/10 R, 3, 257, 0.5 R

[56] References Cited

U.S. PATENT DOCUMENTS

| | | | |
|---|---|---|---|
| 1,292,330 | 1/1919 | Jones | 75/3 |
| 1,415,094 | 5/1922 | Jones | 75/3 |
| 2,127,632 | 8/1938 | Najarian | 75/3 |
| 2,869,850 | 1/1959 | Wienert | 75/3 |
| 3,276,859 | 10/1966 | Collin et al. | 75/11 |
| 3,397,952 | 8/1968 | MacZura et al. | 23/141 |
| 3,480,389 | 11/1969 | Graulier | 23/143 |
| 3,723,093 | 3/1973 | Shiba et al. | 75/10 R |
| 3,853,789 | 12/1974 | Warthen et al. | 252/463 |
| 3,860,416 | 1/1975 | Gautreaux et al. | 75/0.5 B |
| 3,983,197 | 9/1976 | Mitsche et al. | 264/56 |
| 4,019,914 | 4/1977 | Esper et al. | 106/62 |
| 4,251,265 | 2/1981 | Stratton et al. | 75/3 |
| 4,308,088 | 12/1981 | Cherdron et al. | 156/603 |
| 4,379,134 | 4/1983 | Weber et al. | 423/626 |
| 4,388,107 | 6/1983 | Kibby | 75/10 R |

FOREIGN PATENT DOCUMENTS

| | | | |
|---|---|---|---|
| 901138 | 7/1962 | United Kingdom | 75/3 |

*Primary Examiner*—M. J. Andrews

*Attorney, Agent, or Firm*—Alan T. McDonald

[57] ABSTRACT

A composite pellet for use as feed for a carbothermic alumina reduction furnace is disclosed. A carbonaceous core is surrounded by substantially carbon-free alumina shell. The resulting pellet has increased thermal and electrical stability in the reduction furnace.

7 Claims, 1 Drawing Figure

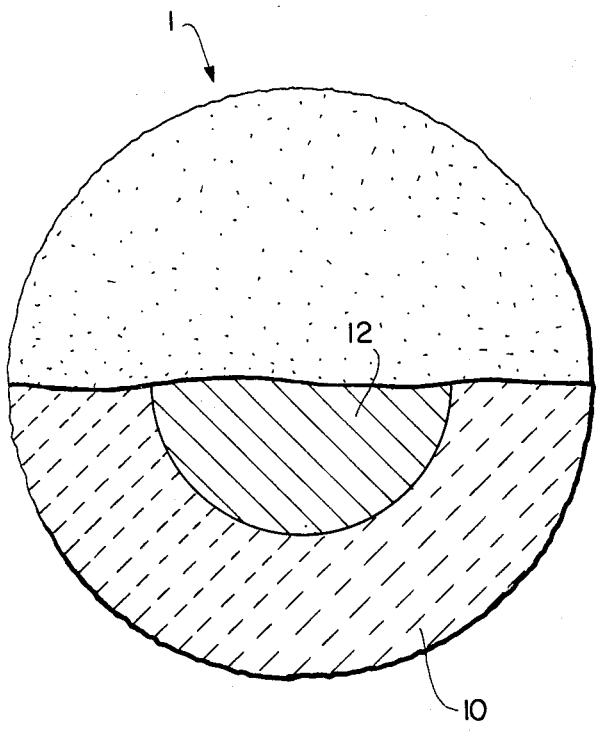
1
12
10

COMPOSITE PELLET FOR USE AS A CARBOTHERMIC REDUCTION FEED

BACKGROUND OF THE INVENTION

Alumina may be reduced to metallic aluminum by means of a carbothermic reduction process. This process is carried out at high temperature in an electric arc furnace.

The starting charge materials for this reduction process are solid particles of carbon and alumina. These materials are fed from the top of the furnace, collecting as a column and surrounding one or more carbon electrodes mounted within the furnace.

The actual reduction process takes place in the electric arc, at temperatures in excess of 2400° C., thus, high temperatures prevail throughout the furnace.

There are several major problems caused by the nature of the charge materials to such a furnace. First, the bare carbon particles within the charge may complete an electrical circuit between the electrodes, whether there be multiple centrally located electrodes in the furnace or a single electrode, with the inner wall or hearth of the furnace acting as the second electrode. Completion of this circuit short circuits the furnace, reducing its efficiency.

Due to the high temperatures within the furnace, two additional problems result. The carbon particles may be air burned while in the charge column, reducing the available carbon and requiring an additional carbon input to overcome this burning process so that the required carbon level for reduction is met.

Also, temperatures approaching 2000° C. at the bottom of the charge column may result in premature melting of the charge materials in the column, possibly causing the charge column to collapse.

It is desirable, therefore, to provide a charge for a carbothermic alumina reduction furnace which electrically insulates the carbon in the charge from the electrodes while in the charge column and which thermally insulates the carbon in the charge column, such that air burning of the carbon and premature melting of the charge are substantially reduced.

THE PRESENT INVENTION

By means of the present invention, these desired results are obtained. The present invention comprises a composite pellet for use as a feed to carbothermic alumina reduction furnaces. The composite pellet of the present invention comprises a carbonaceous core which contains all of the carbon necessary for the carbothermic reduction process to take place. This core may be provided as a solid piece, such as a lump of green (uncalcined) petroleum coke, containing from about 75 to about 95% by weight carbon, or may be formed from powdered carbon mixed with alumina and water and formed into the core.

Surrounding this carbonaceous core is a thermal and electrical insulating shell which contains substantially no carbon. This shell, along with any alumina that was mixed with the carbon in the core, provides the necessary alumina for the carbothermic reduction process.

When employing the composite pellet of the present invention, the carbon is electrically insulated by the alumina, substantially reducing the possibility of short circuits in the reduction furnace, and the carbon is thermally insulated by the alumina, substantially reducing the chances of carbon air burning and premature melting of the charge column.

BRIEF DESCRIPTION OF THE DRAWING

The composite pellet of the present invention will be more fully described with reference to the drawing in which:

The FIGURE is a front elevational view, partially in section, of the composite pellet of the present invention.

DETAILED DESCRIPTION OF THE PREFERRED EMBODIMENTS

Turning now to the FIGURE, composite pellet 1 of the present invention is illustrated. The composite pellet 1 includes a carbon-containing core 12 and a substantially carbon-free shell 10. The compositions and formation of these components 12 and 10 will now be described.

The process of carbothermic reduction of alumina to form aluminum has been well described in the literature. Thus, for example, the various reactions occurring in a carbothermic reduction furnace are described in U.S. Pat. No. 4,388,107, the disclosure of which is hereby incorporated herein by reference.

In order to maintain the various reactions in a carbothermic reduction furnace, the pellets of the present invention may comprise, on an overall weight basis, approximately 25–90% carbon and 10–75% alumina. It is of primary importance, of course, that substantially all of the carbon in the pellet 1 be provided within core 12 and that the shell 10 of the pellet 1 be substantially carbon-free.

Of the 10–75% by weight of the overall pellet 1 comprising alumina, it is preferred that at least 5% by weight of the alumina, and up to about 100% by weight of the alumina, be provided in the form of aluminum trihydrate. Aluminum trihydrate, when mixed with water, forms a paste which may then be pelletized and dried to form a more stable body than pure alumina.

The core 12 may be formed of from about 75 to about 95% by weight carbon. If, for example, a solid lump of petroleum coke is provided as the core 12, this will be the case. However, the carbon in the core 12 may also be provided in powder form. In that case, the carbon itself will not pelletize, and will be mixed with a portion of the alumina component and formed into core 12. The core 12 will then be surrounded by the remainder of the alumina-providing component as shell 10.

A small amount, for example up to about 10% by weight, of aluminum fluoride may be substituted for alumina in the alumina component. The aluminum fluoride aids in the binding of the pellet as will be described below.

Preferably, that portion of the alumina which is provided as alumina, rather than as aluminum trihydrate, will be a "low alpha phase" alumina, containing not more than about 20% alpha phase alumina, again to increase the binding characteristics of the pellet.

EXAMPLE I 9.5 grams of alumina and 0.5 grams of aluminum trihydrate were mixed with 7.5 grams of water to form a paste. Half of this mixture was combined with 10.0 grams of carbon powder and rolled into a pellet core. The remaining 50% of the paste was molded around the core and the composite pellet was dried at a temperature of 110° C. for a period of 12 hours. The resulting pellet could be handled by hand without crumbling.

EXAMPLE II

A paste was formed, similar to that in Example I, but with 9.0 grams of alumina, 1.0 grams of aluminum trihydrate and 9.0 grams of water. One half of this paste was again mixed with 10.0 grams of carbon and rolled into a core, with the remaining half of the paste being molded around the core. After drying the composite pellet for 12 hours at 110° C., the resulting pellet could be handled by hand without crumbling.

EXAMPLE III

A paste was formed from 8.0 grams of alumina, 2.0 grams aluminum trihydrate and 9.3 grams water. One half of this paste was mixed with 10.0 grams of powdered carbon to form a pellet core, with the remaining half of this paste being molded around the paste. After drying for 12 hours at 110° C., the pellet could be handled by hand without crumbling.

In each of the above examples, the alumina was a low alpha phase alumina, containing not more than 1–2% alpha phase alumina. The aluminum trihydrate was in the form of a finely divided power, and the carbon was also in the form of a finely divided powder.

The above examples illustrate the strength at room temperature of the composite pellets formed by the present invention. When fed to the charge column of the carbothermic reduction furnace, it is believed that the pellets obtain additional strength in three manners.

First, at a temperature of approximately 300° C., the aluminum trihydrate present in the pellet reacts according to the following equation:

$$2Al(OH)3 \rightarrow Al_2O_3 + 3H_2O$$

When the paste of alumina and aluminum trihydrate is formed, the aluminum trihydrate penetrates the pores and cracks present in the surface of the alumina grains. The conversion of aluminum trihydrate to aluminum oxide produces a connecting matrix of material, capable of forming a fairly strong body.

The second bonding mechanism results from the growth of alpha phase alumina crystals from the non-alpha phase alumina crystals present in the alumina, at a temperature of approximately 1000° C. This crystal growth is stimulated by the presence of a small amount of aluminum fluoride, as previously described.

Finally, at a temperature of approximately 1200° C. and above, the aluminum oxide grains begin to fuse and sinter together.

The alumina shell surrounding the carbonaceous core insulates the carbon both thermally and electrically. Thus, a substantially reduced likelihood of short circuits in the furnace results and there is a less likelihood of carbon air burning in the furnace. Further, due to the bonding mechanisms stated above, there is increased stability of the pellet, reducing the chances of early disintegration of the components and collapse of the charge column in the furnace.

From the foregoing, it is clear that the present invention provides a stable charge for a carbothermic alumina reduction furnace.

While the invention has been described with reference to certain specific embodiments thereof, it is not intended to be so limited thereby, except as set forth in the accompanying claims.

I claim:

1. A composite pellet suitable for use as a feed for a carbothermic alumina reduction furnace, said pellet consisting of a core and a shell surrounding said core, said core consisting essentially of carbon and optionally alumina and said shell consisting essentially of alumina and being essentially carbon-free, said pellet consisting essentially of, on an overall weight basis, approximately 25–90% carbon and 10–75% alumina.

2. The pellet of claim 1 wherein said core consists of a lump of petroleum coke having a carbon content ranging between about 75 to about 95% by weight carbon.

3. The pellet of claim 1 wherein said core consists essentially of a mixture of carbon powder and alumina.

4. The pellet of claim 1 wherein at least 5% by weight of said alumina component in said pellet is in the form of aluminum trihydrate.

5. The pellet of claim 1 wherein said alumina component in said pellet is low alpha phase alumina.

6. The pellet of claim 4 wherein said alumina component in said pellet which is not in the form of aluminum trihydrate is low alpha phase alumina.

7. The pellet of claim 1 wherein up to about 10% by weight of said alumina component in said pellet is substituted by aluminum fluoride.

* * * * *